United States Patent [19]

Miller

[11] Patent Number: 5,039,102

[45] Date of Patent: Aug. 13, 1991

[54] CARD READER FOR BLACKJACK TABLE

[75] Inventor: Arthur C. Miller, Las Vegas, Nev.

[73] Assignee: Tech Art, Inc., Las Vegas, Nev.

[21] Appl. No.: 446,205

[22] Filed: Dec. 4, 1989

[51] Int. Cl.[5] ..... A63F 1/06

[52] U.S. Cl. ..... 273/148 R; 273/148 A; 273/296; 273/304; 273/309

[58] Field of Search ..... 273/148 R, 148 A, 309, 273/149 R, 149 P, 138 R, 138 A, 85 CP, 296, 303, 304; 108/23

[56] References Cited

U.S. PATENT DOCUMENTS

| | | | |
|---|---|---|---|
| 2,046,595 | 7/1936 | Yerkes | 273/309 |
| 4,314,700 | 2/1982 | Dylag | 273/309 |
| 4,534,562 | 8/1985 | Cuff et al. | 273/149 P |

FOREIGN PATENT DOCUMENTS

| | | | |
|---|---|---|---|
| 1356398 | 2/1964 | France | 273/304 |

*Primary Examiner*—Edward M. Coven

*Assistant Examiner*—Jessica J. Harrison

*Attorney, Agent, or Firm*—Malin, Haley, McHale, DiMaggio & Crosby

[57] ABSTRACT

A card reader for a blackjack table comprised of a card reading device and a housing therefor, said housing attachable to the blackjack table. The card reading device has associated therewith a light source, a power source for energizing said light source, and a platform coplanar with said blackjack table defining an aperture for reading a portion of a face-down playing card. Said aperture is covered partially by a cover to minimize the opportunity of black jack players other than the dealer to view the portion of the card being inspected. A reflective surface is disposed generally below said aperture to reflect the portion of the face-down card being read through the non-covered portion of the aperture to reveal to the dealer any indicia on the portion of the face down card being read. There is also disclosed herein a method for increasing the speed of play in an organized game of blackjack.

6 Claims, 2 Drawing Sheets

FIG. 1
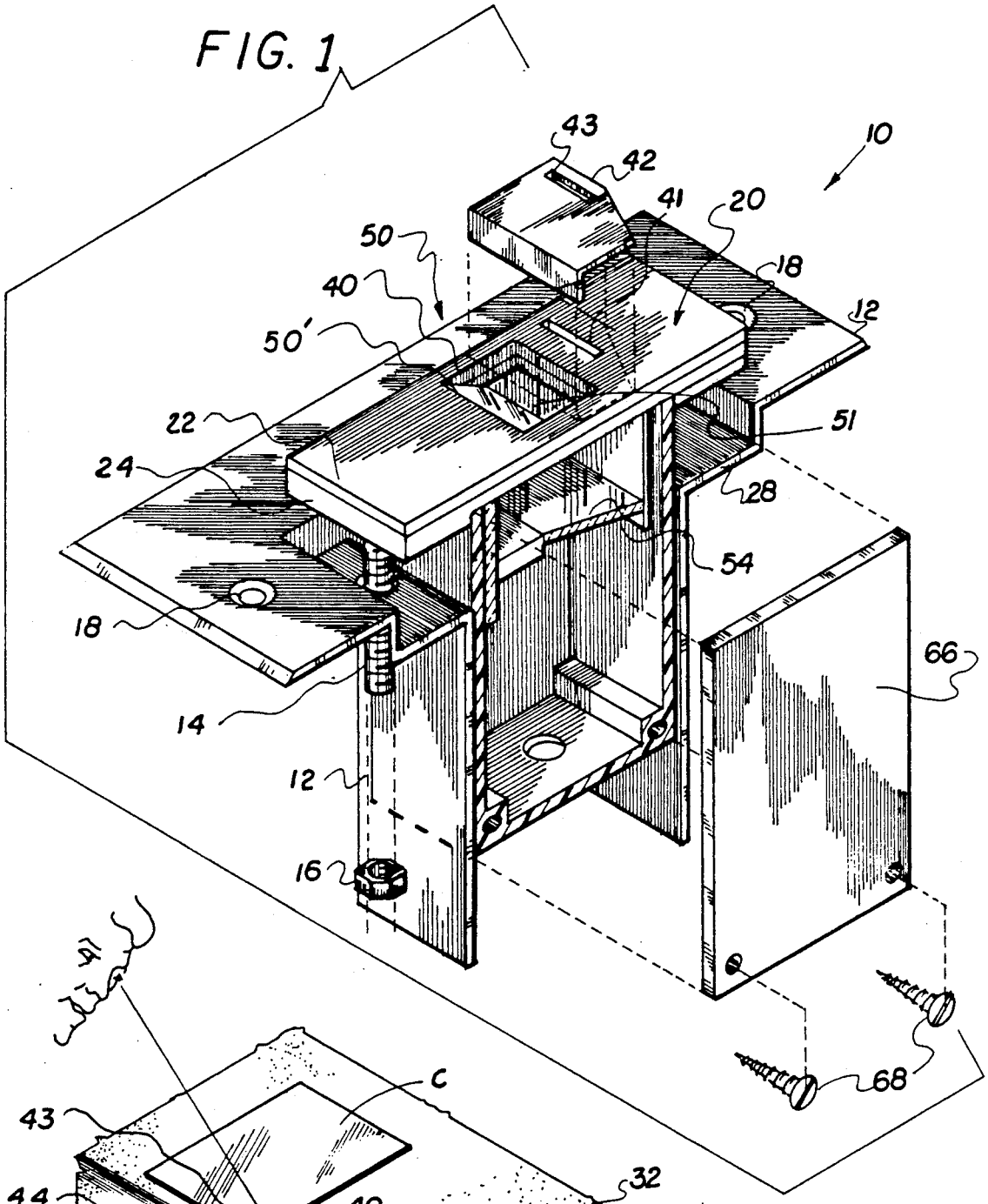
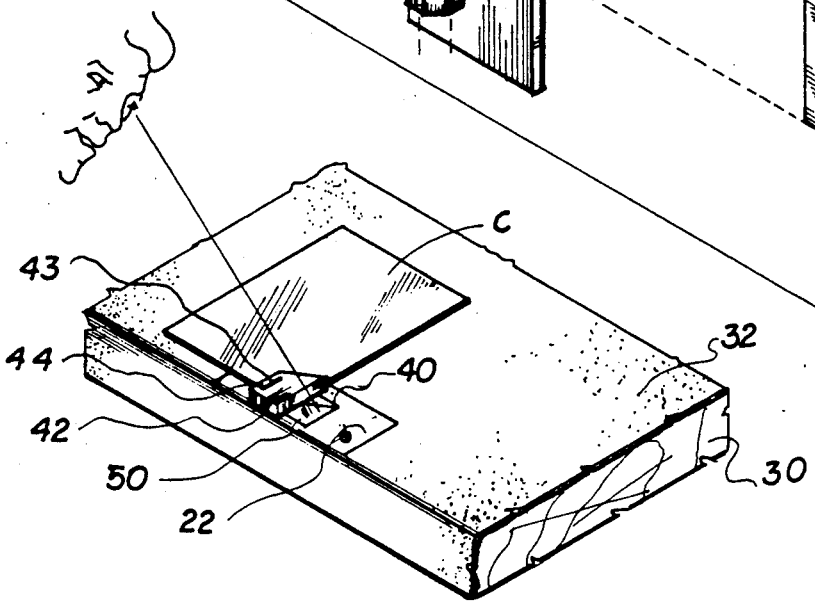
FIG. 2
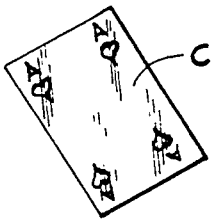
FIG. 6

CARD READER FOR BLACKJACK TABLE

BACKGROUND OF THE INVENTION

1. Field of the Invention

The instant invention relates to an apparatus for reading a playing card and more particularly relates to a device for reading a corner of a playing card whilst the playing card is face-down on a blackjack table.

2. Prior Art

The business of a modern gambling casino requires careful attention to efficiency and accuracy to enhance the fairness of play and the profitability of the various tables. Not only is the speed of play deemed critical by the individual casinos, but most players prefer, and in fact demand, a rapid pace of play. Further, the element of fairness is of utmost importance to both casino owner and player alike.

In the game of blackjack, a time consuming delay arises when the dealer's up card, that is, his exposed card, has a value of ten, and his down card is an Ace. In this case the dealer will play out the hand with the players at the table. After dealing to the last player, the dealer will expose his down card. If his down card is an Ace and his face-up card has a value of ten, the dealer has twenty-one and automatically wins. If the value of the down card held by the dealer could have been ascertained without breaching the necessary level of security at the table, the time consumed in dealing out to the remaining players after the dealer had earlier obtained twenty-one could have been avoided and a new hand commenced. Throughout the course of play, the unnecessary delays resulting from this occurence accumulate to a substantial amount of time. This delay can be avoided if it can be determined when the dealer is dealt twenty-one.

However, because casinos now forbid dealers to look at their down cards during a game of 21 for security reasons, dealers presently have no way of determining if they have twenty-one until all players have played out the hand. That is, the exposure of any card not intended to be seen by anyone but the dealer imposes a risk to the security of the hand. Further, a dealer, if so inclined, can easily cheat by looking at his down card and providing a serruptitious signal to a cohort player.

When weighed in light of the foregoing discussion on the desirability of ascertaining the dealer's down card when his up card has the value of ten, some means are required to speed up play in a manner that is both fair to the players and of low risk to the casino. The inventor is not aware of any devices currently available which address the aforementioned problem.

SUMMARY OF THE INVENTION

The instant invention, intended to cure the above mentioned shortcomings in the art, is comprised of a card reading means associated with a housing, a light source associated therewith, means for energizing said light source associated with said card reading means and a surface means for placing a playing card thereon to read the playing card using said card reading means. The apparatus is used in conjunction with a deck of cards wherein the Aces have a marking at all four corners thereof, unlike a typical playing card wherein indicia (e.g. 5, 7, Q, A) are disposed in only the upper left hand and lower right hand corners. In the speciality deck contemplated with the instant invention, additional indicia is disposed on only the Ace cards in the upper right and lower left hand corners. The card reader means is adapted to receive only the upper right hand or lower left hand corner of the dealer's down card so as to reveal either the "ace" indicia if the down card is an ace or nothing at all if the down card is any other card in the deck. Switch means may be operably associated with said card reader means wherein insertion of the dealer's down card in association with said card reading means activates said switch means, activating the light source to illuminate the underside corner portion of the down card being read.

The card reader means is generally comprised of a receiving means to receive a corner of said card being read connected to said surface means, said surface means defining an aperture, part of said aperture being disposed generally vertically below the receiving means, wherein when the corner of said down card is inserted within the receiving means, at least a portion of said corner of said down card overlays said aperture, which is disposed generally vertically above a mirrored surface angled so that the image of the corner of said down card is viewable through the portion of the aperture which does not lie generally vertically below said receiving means. In this way, the dealer can insert either the upper right or lower left hand corner of his down card face-down in the receiving means, and read only that corner to ascertain whether there is indicia corresponding to an Ace thereon by viewing through the portion of said aperture which is not covered by said receiving means. The surface means is connected coplanarly to the blackjack playing table.

A further aspect of the invention lies in the method for increasing the speed of play of the game of blackjack in a fair and secure manner comprising the steps of dealing a hand of blackjack to a plurality of players, including the dealer, ascertaining whether the dealer's down card is an Ace, and if said down card is an Ace terminating the hand, or alternatively, if said down card is other than an Ace, continuing to play.

It is a principal object of the instant invention to provide an apparatus for reading indicia from a portion of the playing card in a game of blackjack.

It is also an object of the present invention to provide an apparatus and method for speeding up the play in organized blackjack in a fair and secure manner.

It is a further object of the present invention to provide a method of reading specialized indicia from a playing card in a game of blackjack.

BRIEF DESCRIPTION OF THE DRAWINGS

FIG. 1 shows a perspective exploded view of the invention for reading playing cards.

FIG. 2 shows the invention being used to read a faced down playing card on a typical blackjack table.

DETAILED DESCRIPTION OF THE PREFERRED EMBODIMENT

Figure 3:
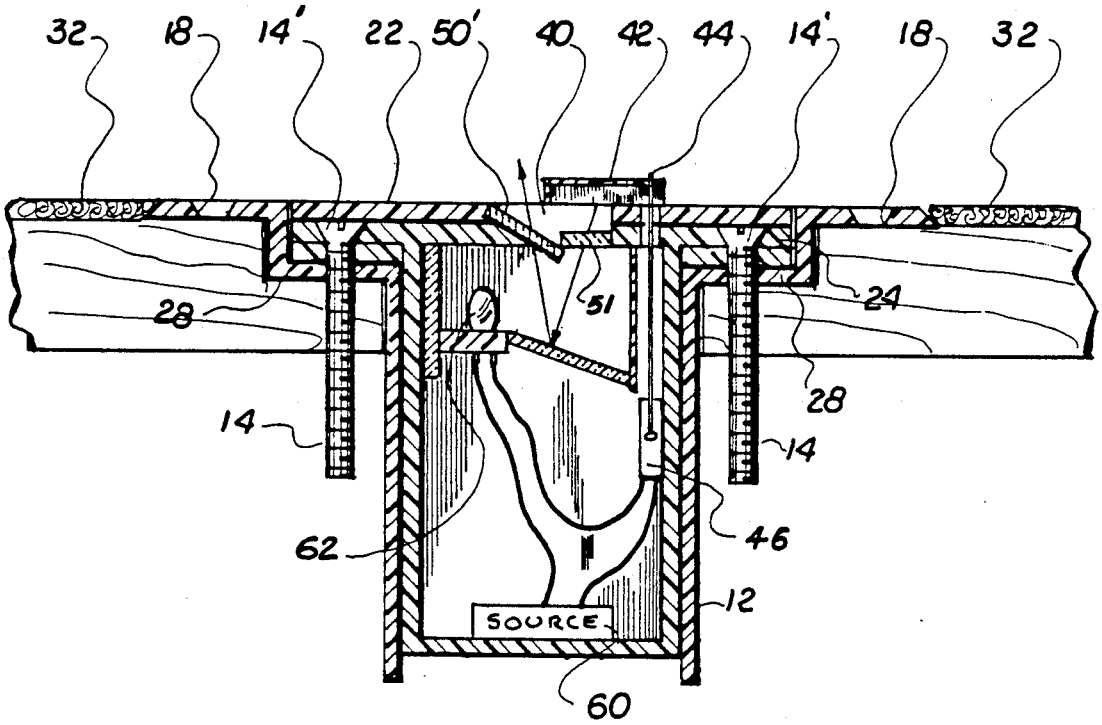
FIG. 3 shows a sectional view of the instant invention mounted to a blackjack table.

Referring now to the drawings, FIG. 1 shows the card reader of the instant invention generally designated by the reference numeral 10 comprised of a housing means 12 adapted to be connected to a conventional blackjack casino table by conventional attachment means (not shown), such as by countersunk screws (not shown) passed through apertures 18 defined by the horizontal upper surface of housing 12. Housing 12 is comprised generally of a hollow rectangular portion integrally connected to a horizontal upper planar portion, said horizontal upper planar portion adapted to receive a card reading means 20.

In the preferred embodiment, the card reading means is comprised of an upper horizontal platform member 22 connected to a lower horizontal platform member 24 in co-planar association. As it is preferred that the platform member 22 form a smooth surface so as not to mar any of the playing cards which will come into contact therewith, the means for connecting said card reading means to said housing should be concealed. To this end, threaded bolts 14 are passed through apertures in lower platform member 24 and downwardly through corresponding apertures defined by ledge members 28 of housing means 12. Upper platform member 22 may then be laminated to lower platform member 24 to conceal the heads 14' of bolts 14. As best shown in FIGS. 1 through 3, the card reader 10 disclosed herein is intended to fit in generally coplanar arrangement with the covering material 32 of conventional blackjack table 30.

The upper and lower platform members 22 and 24 make up a portion of card reading means 20 and define an aperture 40 through which a corner of the dealers' down card can be read. An opaque hood means 42 is preferably connected to the upper platform member 22 at a point whereby said hood means covers a portion of said aperture 40. An elongated slot means 41 is disposed in the upper platform member 22 adjacent said aperture 40 which is adapted to correspond to slot means 43 in hood means 42. Said slots 41 and 43 are sized and shaped to receive toggle member 44 of microswitch 46.

Disposed within aperture 40 may be a viewing means 50, which must be a transparent material if used. In the preferred embodiment, shown in FIGS. 1 through 3, viewing means 50 is comprised of a first, angled segment 50' and a second, horizontal segment 51. Angling the first segment of viewing means 50 results in reduced glare off of the outwardly facing surface thereof, enhancing the dealers' readability of the reflected image of the corner of the playing card being viewed.

In order to produce a reflected image, a reflective surface 54 is disposed within the body of card reading means 20 and supported in position such that when a corner of the playing card 15 is inserted under cover 42 and thereby over aperture means 40, any indicia thereon will be reflected off of reflective surface 54 and through viewing means 50, allowing the dealer to determine whether or not the playing card is either an Ace or other than an Ace, as shown in FIG. 2.

Also in the preferred embodiment, as shown in FIG. 6, the Aces of a typical deck of cards used in the game of blackjack are modified by placing indicia on all four corners instead of the usual fashion of placing indicia only on the upper left hand and lower right hand corners. In this way, if the card being viewed through the card reading means is other than an Ace, its value will not be known by the dealer.

Figure 4:
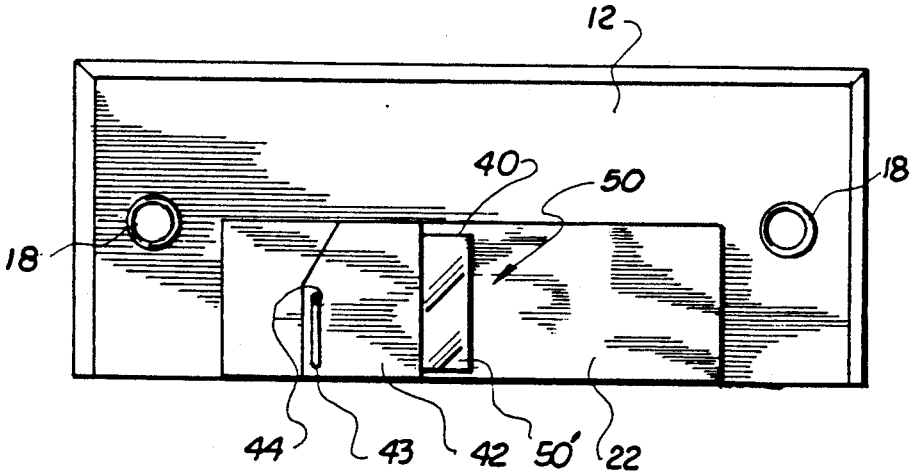
FIG. 4 shows a top plan view of the invention.

To assist the dealer in reading the card under consideration clearly and easily, light means may be provided in the form of a power source 60 connected to microswitch 46, said switch activating light 62 when toggle 44 is moved from the first, off position shown in FIG. 4 to the second, on, position shown in FIG. 2.

The housing means 12 is preferably provided with a removable panel member 66 to allow access to the interior of the card reading means for replacement of the bulb or for any other reason. Said removable panel member 66 may be secured to either housing means 12 or card reading means 20 by any convenient means such as screws 68.

The device is used as follows: After the initial deal of a hand of blackjack, the dealer has one face-up card and one face-down card. If his face-up card has a value of 10, it is desirous to ascertain the value of the dealers' down card C. If the dealer's down card C is an Ace, the hand can be called because the house wins, and no further time need be wasted on a moot hand. To ascertain whether or not the dealers' down card C is an Ace, the special Aces referred to above and shown in FIG. 6 having been substituted into the deck or decks being used, the corner of the down card of the dealer is inserted under cover means 42, thereby moving toggle means 44 from the off to the on position, illuminating light 62, and enabling the dealer to inspect the underside of the corner of the down card being read as the corner of the downward placed in hood means 42 is reflected off of reflective surface 54. If no indicia is shown, the card is other than an Ace and the hand continues. If the corner shows an Ace or other indicia, the dealer immediately knows that the downcard is an Ace and that the dealer has 21, at which time the hand can be terminated.

Figure 5:
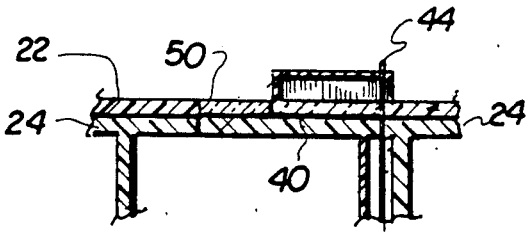
FIG. 5 shows a partial cut-away view of an alternative embodiment of the instant invention.

FIG. 5 shows an alternative embodiment, wherein viewing means 50 is comprised of a planar piece of transparent material disposed generally horizontally across aperture means 40, coplanar with upper platform 22.

The instant invention has been shown and described herein in what it is considered to be the most practical and preferred embodiment. It is recognized, however, that departures may be made therefrom within the scope of the invention and that obvious modifications will occur to a person skilled in the art.

I claim:

1. A device for reading a portion of a specialized playing card in a game of blackjack, comprising:

a housing including a generally horizontally disposed top planar surface, said surface defining a means for viewing said portion of said specialized playing card while said playing card is disposed face-down on said top planar surface;

receiving means adapted to receive said portion of said specialized playing card to be read, said receiving means being integrally connected to said top planar surface generally vertically above a portion of said viewing means;

reflecting means for reflecting the image of said portion of said specialized playing card through said viewing means when said playing card is inserted within said receiving means.

2. The device of claim 1, further comprising an illumination means for illuminating the portion of said specialized playing card to be read when said portion of said playing card is received by said receiving means.

3. The device of claim 2, further comprising switch means associated with said receiving means for energizing said illumination means.

4. The device of claim 1, wherein said device for reading is connected to a blackjack table in coplanar fashion.

5. The device of claim 3, wherein said device for reading is connected to a blackjack table in coplanar fashion.

6. A method of using a card reading device for reading a specialized playing card and increasing the speed of play of a game of blackjack in a fair and secure manner, said card reading device being characterized as having a housing including a generally horizontally disposed top planar surface, said surface defining a means for viewing said portion of said specialized playing card while said playing card is disposed face-down on said top planar surface, receiving means adapted to receive said portion of said specialized playing card to be read, said receiving means being integrally connected to said top planar surface generally vertically above a portion of said viewing means, reflecting means for reflecting the image of said portion of said specialized playing card through said viewing means when said playing card is inserted within said receiving means, comprising the steps of:

dealing a hand of blackjack to a plurality of players, including the dealer the dealer being dealt a face-up card and a down card;

ascertaining whether the dealers' down card is an Ace, and if said down card is an Ace terminating the hand, or alternatively, if said down card is other than an Ace, continuing to play;

wherein the step of ascertaining whether the dealers' down card is an Ace is carried out using said card reading device to read a portion of a specialized playing card.

* * * * *